United States Patent [19]

Kanno

[11] 4,432,159

[45] Feb. 21, 1984

[54] TOY AND ASSOCIATED NOISE PRODUCING MECHANISM

[75] Inventor: Hideyuki Kanno, Tokyo, Japan

[73] Assignee: Tomy Corporation, Carson, Calif.

[21] Appl. No.: 282,583

[22] Filed: Jul. 13, 1981

[51] Int. Cl.[3] ..... A63H 5/00

[52] U.S. Cl. ..... 46/177; 46/191; 46/201

[58] Field of Search ..... 46/33, 98, 111, 112; 46/114, 174, 175 R, 191, 19 Z, 177, 201, 202, 204, 216, 217; 116/148, 149, 154, 155, 156, 157, 158, 159, 164, 167

[56] References Cited

U.S. PATENT DOCUMENTS

| | | | |
|---|---|---|---|
| 1,949,852 | 3/1934 | Allen | 46/33 |
| 2,533,327 | 12/1950 | Richards et al. | 116/158 |
| 2,679,126 | 5/1954 | Doe et al. | 46/192 |
| 2,992,511 | 7/1961 | Crawford | 46/177 |
| 3,039,424 | 6/1962 | Warn | 116/156 |
| 3,362,102 | 1/1968 | Nomura | 46/191 |
| 3,508,350 | 4/1970 | Genin | 46/177 |
| 4,035,948 | 7/1977 | Fishbein | 46/189 |
| 4,055,914 | 11/1977 | Ieda et al. | 46/192 |

*Primary Examiner*—John J. Wilson
*Assistant Examiner*—Kris R. Schulze
*Attorney, Agent, or Firm*—K. H. Boswell; Edward D. O'Brian

[57] ABSTRACT

A sound producing device for a toy includes a base, and rotatably mounted on the base a rotating member. The rotating member is capable of rotating both clockwise annd counterclockwise. A member is located on the base adjacent to the rotating member such that in response to rotation of the rotating member in a clockwise and counterclockwise direction, respectively, the rotating member contacts and engages the member and moves the member in a first and a second direction, respectively. A noise emitting mechanism is also located on the base and is operatively associated with the member. The noise emitting mechanism is capable of emitting at least two different types of noise. The member in contacting the noise emitting mechanism in response to movement of the member in a first direction causes the noise emitting mechanism to emit a noise of a first type and the member in contacting the noise emitting mechanism in response to movement in a second direction causes the noise emitting mechanism to emit noise of a second type.

11 Claims, 8 Drawing Figures

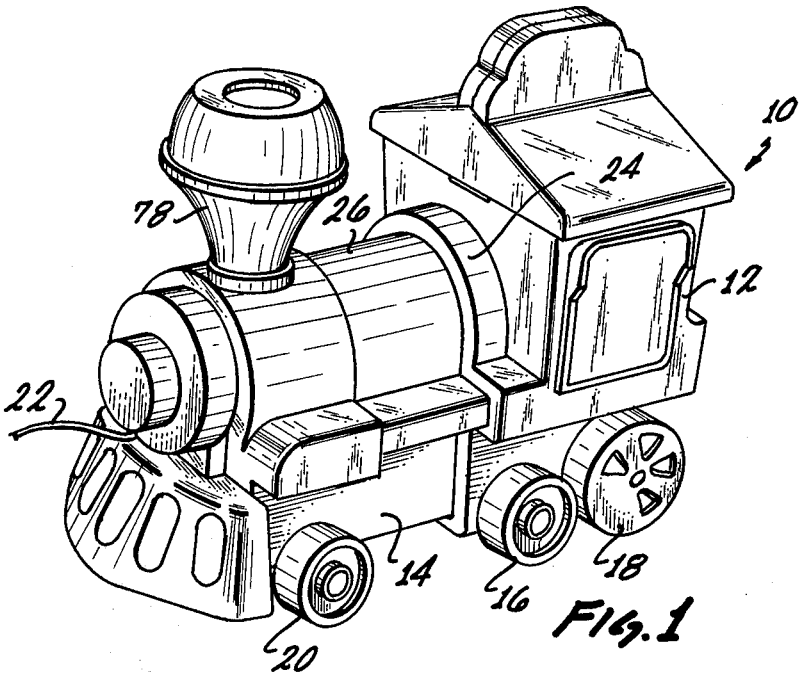
FIG. 1
FIG. 2
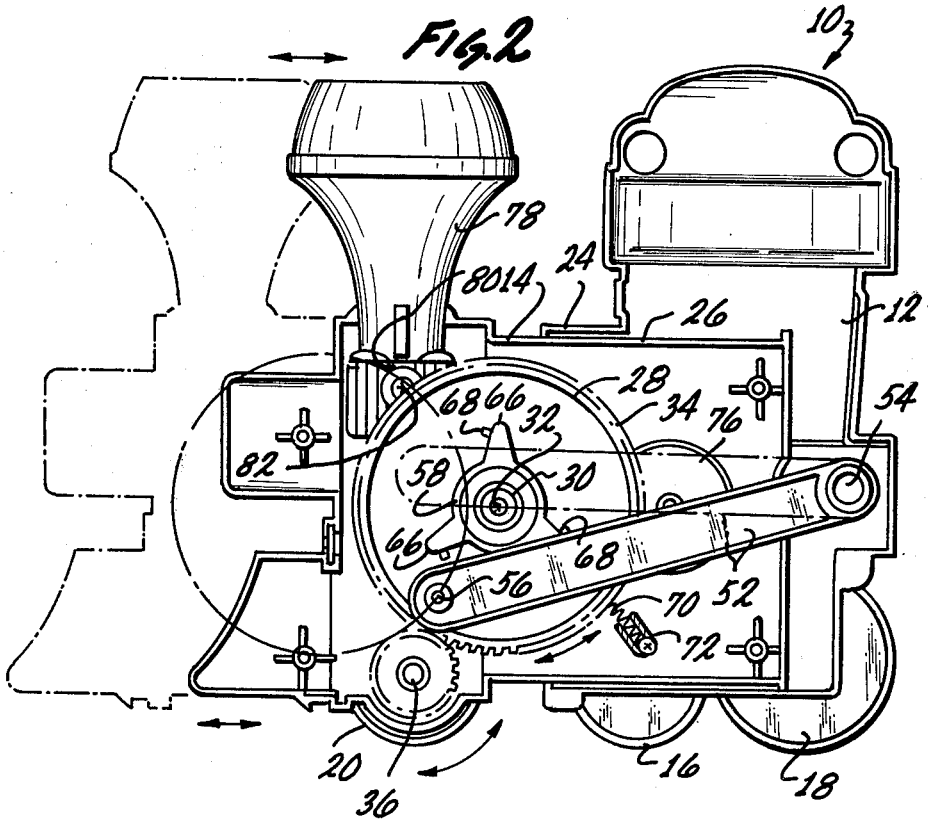

Fig. 7
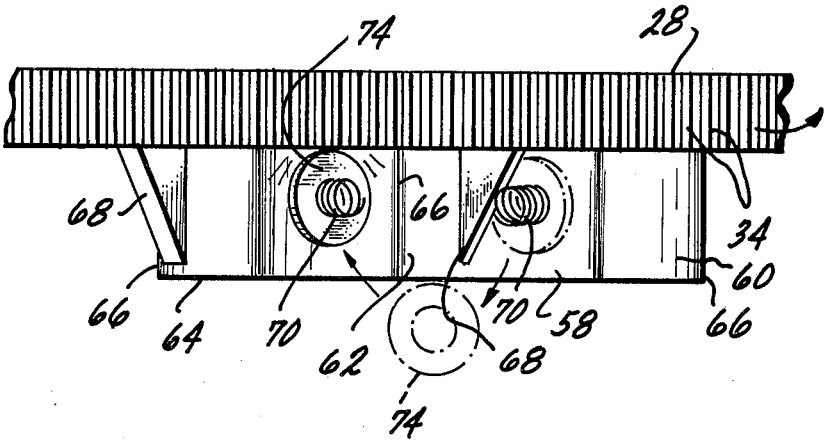
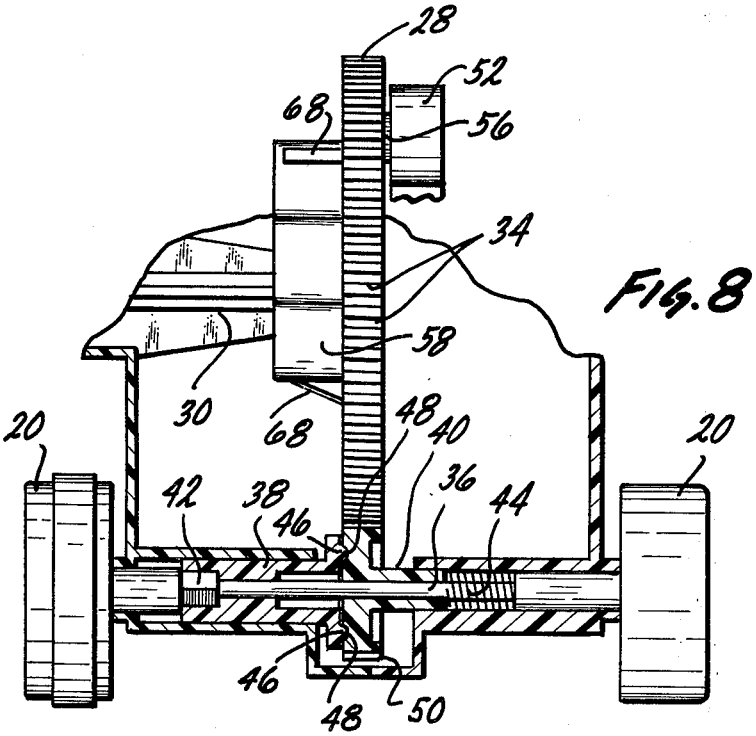
Fig. 8

TOY AND ASSOCIATED NOISE PRODUCING MECHANISM

BACKGROUND OF THE INVENTION

This invention is directed to a sound producing device for a toy. The sound producing device is capable of emitting sounds of at least two different types. The sound producing device includes a member capable of moving in a first and second direction. In response to movement of the member in a first direction, a sound of a first type is emitted and in response to movement of the member in a second direction a sound of a second type is emitted.

Many sound producing devices for use with toys are known. These sound producing devices are normally capable of only emitting a single type of sound. By this it is meant that the device will emit a ringing sound, or will emit a clicking sound, or the like. Sound producing devices for toys which are capable of producing independent sounds of two different types normally are quite complicated in their construction. It is of course conceivable that two totally different sound producing mechanisms could be incorporated within a toy. Each of the mechanisms would be capable of producing a sound of one type differing from the sound produced by another of the mechanisms. This is considered to be disadvantageous in that it complicates the mechanism and in so complicating the mechanism increases production time, production costs, and therefore ultimate costs to the consumer.

In view of the above it is considered there exists a need for a sound producing device for a toy which is capable of producing at least sounds of two different types with the use of a simplified mechanism. Such a sound producing device should be susceptible to economical manufacture and be adaptable for use in a variety of different types of toys.

BRIEF SUMMARY OF THE INVENTION

It is a broad object of this invention to produce a sound producing device which is capable of producing sounds of at least two different types wherein the device is of a simplified nature. It is a further object of this invention that the device incorporate certain engineering and manufacturing procedures allowing for readily adaptability to use in a variety of different toys. It is an additional object of this invention to produce such a device in an economical manner such that its use within a toy does not sufficiently increase the ultimate price of the toy to the consumer.

These and other objects as will become evident from the remainder of this specification are achieved in a sound producing device for a toy which comprises a base; a rotating means rotatively mounted on said base, said rotating means capable of rotating on said base in a clockwise and a counterclockwise direction; a member located on said base adjacent to said rotating means in a position such that at least a portion of said member is capable of being contacted by said rotating means; said rotating means contacting and engaging said member and moving said movable portion of said member in a first direction in response to rotation of said rotating means in one of said clockwise or counterclockwise directions; said rotating means contacting and engaging said member and moving said movable portion of said member in a second direction in response to rotation of said rotating means in the other of said clockwise or counterclockwise directions; a noise emitting means mounted on said base and operatively associated with said movable portion of said member, said noise emitting means capable of emitting noise of at least two different types; said movable portion of said member interacting with said noise emitting means in response to movement of said movable portion of said member in said first direction to cause said noise emitting means to emit a noise of a first type, said movable portion of said member interacting with said noise emitting means in response to movement of said movable portion of said member in said second direction to cause said noise emitting means to emit a noise of a second type.

Preferredly the member comprises an elongated member having one end connected to the base and the other end movable with respect to both the rotating means and the noise emitting means. In the preferred embodiment of the invention the rotating means includes a disk member and a disk member activating means. The disk member is rotatably mounted on the base and the activating means is operatively associated with the disk member and is capable of rotating the disk member in both a clockwise and counterclockwise direction. The disk member will include a cam means mounted on the disk member such that the cam means rotates in response to rotation of the disk member. The cam means is capable of engaging with the movable end of the elongated member to move this movable end in both the first direction and the second direction.

Preferredly the cam means includes a cam surface of a first type and a cam surface of a second type. The cam surface of the first type engages with the movable end of the elongated member and moves the movable end of the elongated member in a first direction and the cam surface of the second type engages with the movable end of the elongated member and moves this movable end in the second direction.

The elongated member can comprise an elongated flexible member capable of being distorted about its longitudinal axis. The movement of the movable end of this elongated flexible member will be in response to flexing of the member.

The noise emitting means in the preferred embodiment of the invention will include both the disk member noted above and a bell member. The movable end of the flexible member in response to movement in the first direction will strike the bell member and in response to movement in the second direction will strike the disk member. The cam surface of the first type will engage the flexible member and cause movement of the movable member in a first plane and the cam surface of the second type will engage the flexible member and cause movement of the flexible member in a second plane. By locating the bell member within the first plane and the disk member within the second plane the flexible member is positioned to strike both the bell member and the disk member depending which plane it is caused to move in. In the preferred embodiment of the invention the cam means will include a plurality of cam surfaces of both the first type and the second type.

The sound producing device of the toy can be mounted within a toy having a first and second component which are mounted with respect to each other and which are capable of moving with respect to each other. Both of these components will include supporting means capable of movably supporting them on a surface. One of the components will contain a crank disk. A connecting rod will pivotally mount the other of the components to the crank disk. Movement of the crank disk is therefore transferred via the connecting rod to the other component such that the two components are capable of moving back and forth with respect to each other.

BRIEF DESCRIPTION OF THE DRAWINGS

This invention will be better understood when taken in conjunction with the drawings wherein:

FIG. 1 is an isometric view of a toy incorporating the device of this invention;

FIG. 2 is a side elevational view in partial section showing the internal components of the toy which constitute the invention; shown in solid lines in FIG. 2 is the configuration of certain parts of the toy in a first spatial relationship with one another and shown in phantom lines is a second spatial configuration of these components with respect to one another;

FIG. 7 is an elevational view about the line 7—7 of FIG. 5; and

FIG. 8 is a front elevational view in section of the toy of FIG. 1.

Figure 3:
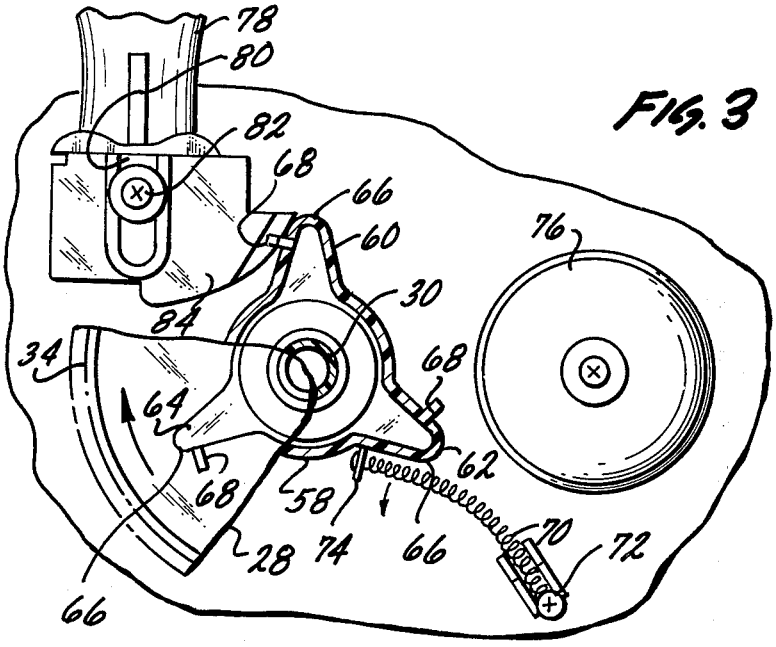
FIG. 3 is a side elevational view in partial section showing the components located in the center of FIG. 2 in a first spatial configuration.

The invention illustrated in the drawings and described in this specification utilizes certain principles and/or concepts which are set forth in the claims appended to this specification. Those skilled in the toy arts will realize that these principles and/or concepts are capable of being utilized in a variety of different embodiments which differ from the exact embodiment utilized for illustrative purposes in the drawings and in this specification. For this reason this invention is to be construed in light of the claims and is not to be construed as being limited to the exact illustrated embodiment herein.

DETAILED DESCRIPTION

In FIGS. 1 and 2 of the drawing a toy engine 10 is shown. In FIGS. 3 through 8 certain of the internal components (hereinafter identified and numbered) located within the interior of the toy engine 10 are shown. Externally the toy engine 10 includes a rear housing portion 12 and a front housing portion 14. The rear housing portion 12 is supported on two sets of wheels 16 and 18, (only the left hand members of each set being shown in the drawings) and the front housing portion 14 is supported on a set of wheels, both collectively identified by the numeral 20. The toy engine 10 is capable of being rolled along a surface by a small child by pulling on string 22 or by pushing on the toy engine 10 directly.

As the child pulls the toy engine 10, the toy engine 10 does two things. First the front and rear housings 14 and 12, respectively, move with respect to one another such that the toy engine 10 first elongates and then contracts as it rolls. FIG. 2 shows this elongation and contraction movement in solid and phantom lines for the front housing 14. In FIG. 2 the rear housing 12 is shown as remaining stationery; however, it will be appreciated that as the toy engine 10 rolls, both housings 12 and 14 move. Secondly, as the toy engine 10 is pulled in a forward manner it emits a ringing sound. If the child choses to push the toy engine 10 in a reverse manner instead of emitting a ringing sound, the engine 10 emits a clack-clack sound. The front and rear housings 14 and 12, respectively, move with respect to one another independent of whether or not the toy engine 10 goes in a forward direction or whether it goes in a reverse direction.

Since the outside motif of the toy engine 10 does not form a part of the invention the individual items constituting this motif will not be identified. There are several portions of the outside of the toy engine 10, however, which serve to facilitate an understanding of the in and out movement of the front housing 14 and the rear housing 12.

A portion of the rear housing 12 is formed as a flange 24. This flange 24 encircles the portion of the front housing 14 which moves in and out of the rear housing 12. For brevity's sake, that portion of the front housing 14 which moves in and out will be considered as a sliding sleeve 26. The sliding sleeve 26 is shaped to mimick the shape of the flange 24 such that the front housing 14 moves in and out of the rear housing 12 in a smooth and easy manner.

Located inside of the front housing 14 is a crank disk 28. This crank disk is pivotally mounted over a boss 30 and held there by an appropriate screw 32. The boss 30 forms a portion of the front housing 14 and is integrally molded with the housing 14 during manufacture. Crank 28 includes a spur gear surface 34 around its periphery.

The front wheels 20 are mounted about an axle 36. A clutch means (not separately numbered or identified) consisting of a first component 38 and a second component 40 are also mounted on axle 36. They are mounted on this axle 36 such that they are free to rotate on the axle 36. The first clutch component 38 meets and mates with an extension 42 formed as part of the right-hand side front wheel 20. The mating of the extension 42 with the component 38 causes the component 38 to spin in response to rotation of the wheel 20. A spring 44 biases second clutch component 40 toward and against first clutch component 38. The first clutch component 38 includes a plurality of projections 46 which mate with and engage an equal plurality of indentations 48 located on second clutch component 40 by the interlocking of the projections in the indentations. Rotation of wheel 20 is therefore transferred to the first clutch component 38 and further transferred to the second clutch component 40. The second clutch component 40 includes a rack of gears 50 around its periphery which meet with and engage gears 34 on the crank disk 28. Rotation of wheel 20 is therefore propagated to crank disk 28, and crank disk 28 normally will rotate in response to rotation of wheel 20.

If the front and rear housing 12 and 14 are held fixed with respect to one another such that they cannot move with respect to one another and wheel 20 is inadvertently turned as might be done when a small child picked the toy up and attempted to turn the wheels, the clutch formed by the first and second clutch components 38 and 40 would slip with respect to one another by having the projections 36 slip out of the indentations 48 in response to movement of the second clutch component 42 against the bias of spring 44. This protects the internal components of the toy from breaking should the child inadvertently spin the wheel 20 when he fixedly held the two housing components 12 and 14 respect to one another.

A connecting rod 52 is attached at one end to a boss 54 formed as a part of rear housing 12. The other end of the connecting rod 52 is attached to a crank pin 56 located on crank disk 28. Thus, one end of the connecting rod 52 is attached to the rear housing 12 and the other end of the connecting rod 52 is ultimately attached to the front housing 14 via crank disk 28 such that in response to rotation of the right front wheel 20 the crank disk 28 rotates which in turn causes movement of the connecting rod 52, which in turn causes the in and out motion of the front housing 14 with respect to the rear housing 12.

Located on one side of the crank disk 28 opposite the side where the crank pin 56 and connecting rod 52 are located is a compound cam 58. The compound cam 58 includes three cam lobes 60, 62 and 64. Each of these cam lobes 60, 62 and 64 are identical and each includes a cam surface 66 of a first type and a cam surface 68 of a second type.

An elongated flexible member 70 is fixedly mounted to the front housing 14 at one of its ends 72 such that the other end 74 is free to move with respect to the fixed end 72 via flexure of the member 70. A bell 76 is located on the front housing 14 adjacent to the compound cam 58 and the flexible member 70. If struck, the bell is free to resonate and emit a ringing sound. This sound will be designated as a sound of a first type. The crank disk 28 also serves as a noise emitter and if struck, will emit a popping or clicking sound. This sound will be designated as a sound of a second type.

Figure 4:
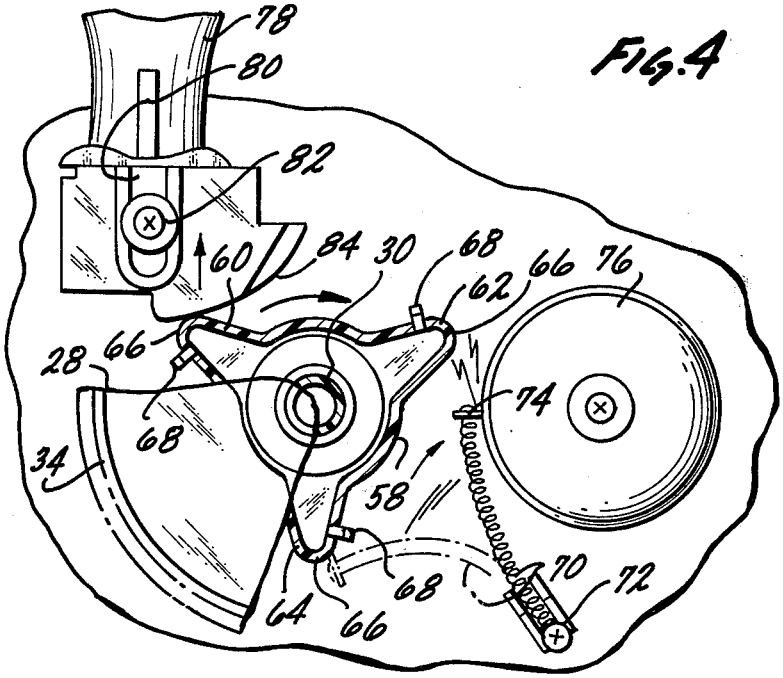
FIG. 4 is a figure analogous to FIG. 3 showing the same components of FIG. 3 in a second spatial configuration.

In response to rotation of the crank disk 28 in a clockwise manner the cam surfaces of the first type 66 will engage and move the end 74 of flexible member 70 away from the bell 76. This movement is depicted in FIGS. 3 and 4. In FIG. 3 the cam surface 66 of cam lobe 62 is just engaging the end 74 of the flexible member 70. In FIG. 4 the cam surface 66 has moved away from the end 74 of flexible member 70 releasing the end 74 of the flexible member 70. The flexible member 70 is self-biased such that when it is distorted as per the movement depicted in FIGS. 3 and 4 and then released, it will go back to its original position; but, because of the momentum it acquires in so moving, it moves past its original position and continues moving until it strikes the bell 76 causing it to emit a ringing sound. This movement will be repeated for the lobes 60 and 64 as the cam 58 rotates in a clockwise direction in response to clockwise rotation of the crank disk 28. The elongated member 70 in moving from an initial rest position to the position of FIG. 3, and through the position shown in FIG. 4 in both phantom and solid line, moves in essentially a first pathway, this first pathway including part of the bell 76 in it.

Figure 5:
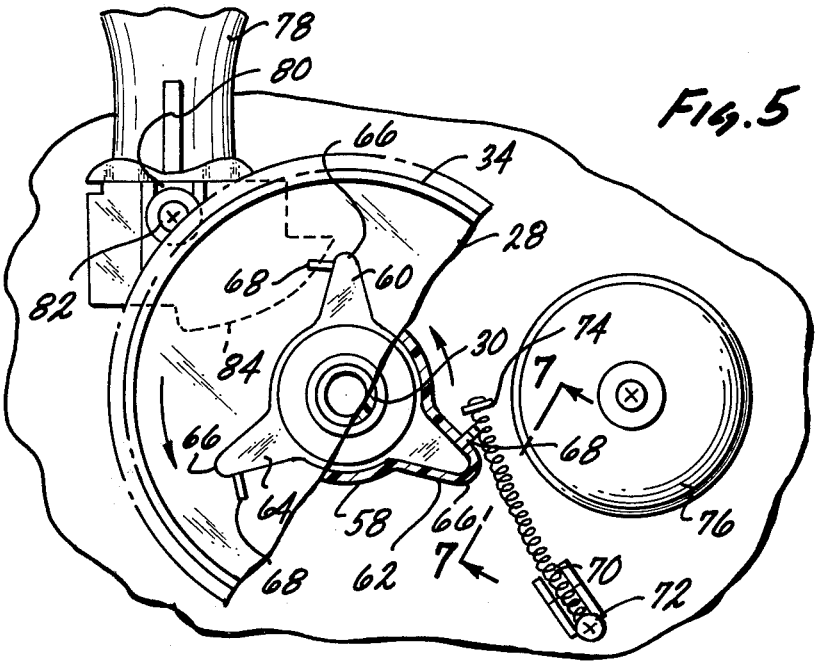
FIG. 5 is a view similar to FIG. 3 showing the components of FIG. 3 in a further spatial configuration.
Figure 6:
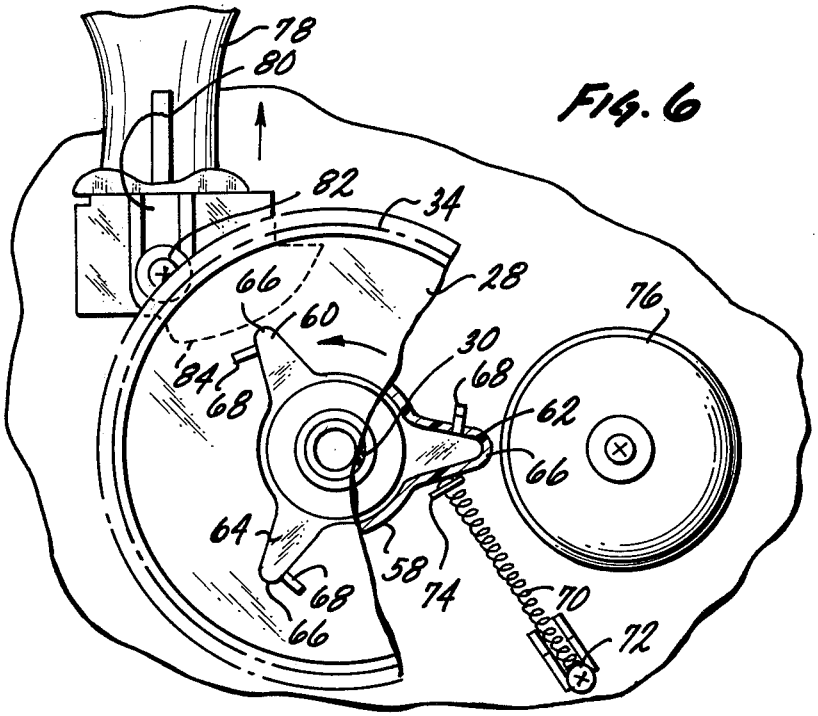
FIG. 6 is a view similar to FIG. 3 showing the components in FIG. 3 in an even further spatial configuration.

In response to counterclockwise rotation of the cam 58 the end 74 of the elongated member 70 moves in a different manner. This is depicted in FIGS. 5, 6 and 7. With clockwise rotation the cam surfaces of the second type—cam surfaces 68—engage the end 74 of the elongated member 70 and initially push it to the right toward the bell 76. As can be seen in FIG. 7, the cam surfaces 68 are wedge shaped. The tension produced in the elongated member 70 in being distorted to the right of its central position as seen in FIG. 5 causes the end 74 to descend along the wedge shape of the cam surface 68. This depresses it from the pathway discussed above and moves it in a second pathway. When the end 74 is completely below the cam surface 68 as seen in the central phantom line in FIG. 7, the end 74 has become disengaged from the cam surface 68 and under the bias incorporated within the elongated flexible member 70, the end 74 is moved upwardly under its own momentum until it strikes the surface of crank disk 28 emitting the sound of the second type. The striking of this surface can be seen in solid line in FIG. 7. The phantom line in FIG. 7 on the right-hand side of FIG. 7 illustrates the position of the end 74 when the cam surface 68 first engages it; the central phantom line depicts the end 74 as it is coming free of surface 68, and as just noted, the solid line depicts the end 74 in its position as it strikes the crank disk 28.

The smoke stack 78 of the toy engine 10 includes a slot 80 in it by which it is mounted about screw 82 to housing 14. This allows the smoke stack 78 to slide up and down in an oscillatory motion such that the smoke stack 78 raises and lowers with respect to the remainder of the front housing 14. On the lower end of the smoke stack 78 is a cam follower surface 84 which is positioned such that it can engage with the cam 58. Whether or not the cam 58 rotates clockwise or counterclockwise, the lobes 60, 62 and 64 of the cam 58 engage the cam follower surface 84 and alternately, upon rotation of the cam 58, cause the smoke stack 78 to go up and down. As noted above the cam 58 rotates in response to movement of the crank disk, whether it be clockwise or counterclockwise; thus, the smoke stack 78 will oscillate up and down independent of whether the toy engine 10 is pushed forward or backward along a surface.

I claim:

1. A sound producing device which comprises:

a base;

a rotating means rotatively mounted on said base, said rotating means capable of rotating on said base in both a clockwise and a counterclockwise direction;

an elongated member having ends, said member located on said base adjacent to said rotating means with one of said ends connected to said base in a position such that the other of said ends of said member comprises a movable end which is capable of being contacted by said rotating means;

said rotating means contacting and engaging said member and moving said movable end of said member in a first direction in response to rotation of said rotating means in one of said clockwise or counterclockwise directions;

said rotating means contacting and engaging said member and moving said movable end of said member in a second direction in response to rotation of said rotating means in the other of said clockwise or counterclockwise directions;

a noise emitting means mounted on said base and operatively associated with said movable end of said member, said noise emitting means capable of emitting noise of at least two different types;

said movable end of said member interacting with said noise emitting means in response to movement of said movable end of said member in said first direction to cause said noise emitting means to emit a noise of a first type, said movable end of said member interacting with said noise emitting means in response to movement of said movable end of said member in said second direction to cause said noise emitting means to emit a noise of a second type.

2. The sound producing device of claim 1 wherein:
said movable end is movable with respect to both of said rotating means and said noise emitting means;
movement of said movable end in said first direction being non co-planar with respect to said movable end in said second direction.

3. The sound producing device of claim 2 wherein:
said rotating means includes a disk member and a disk member activating means;
said disk member rotatively mounted on said base;
said activating means operatively associated with said disk member and capable of rotating said disk member in both said clockwise and said counterclockwise directions.

4. The sound producing device of claim 1 wherein:
said base includes a first component and a second component, said first component movably mounted with respect to said second component, each of said first and second components including moving means capable of movably supporting said components on a surface;
said rotating means including a crank disk rotatively mounted in one of said first or said second components;
a connecting rod pivotally mounted to the other of said first or said second components at one of its ends and pivotally mounted to said crank disk at the other of its ends such that rotating movement of said crank disk moves said first component reversibly back and forth with respect to said second component.

5. A sound producing device which comprises:
a base;
a rotating means rotatively mounted on said base, said rotating means capable of rotating on said base in both a clockwise and a counterclockwise direction;
a member having ends with at least one of said ends comprising a movable end located on said base adjacent to said rotating means in a position such that said member with said movable end is capable of being contacted by said rotating means;
said rotating means contacting and engaging said member and moving said movable end of said member in a first direction in response to rotation of said rotating means in one of said clockwise or counterclockwise directions;
said rotating means contacting and engaging said member and moving said movable end of said member in a second direction in response to rotation of said rotating means in the other of said clockwise or counterclockwise directions;
a noise emitting means mounted on said base and operatively associated with said movable end of said member, said noise emitting means capable of emitting noise of at least two different types;
said movable end of said member interacting with said noise emitting means in response to movement of said movable end of said member in said first direction to cause said noise emitting means to emit a noise of a first type, said movable end of said member interacting with said noise emitting means in response to movement of said movable end of said member in said second direction to cause said noise emitting means to emit a noise of a second type;
said member further comprises an elongated member having the other of its ends connected to said base said movable end being movable with respect to both said rotating means and said noise emitting means;
movement of said movable end in said first direction being non co-planar with respect to said movable end in said second direction;
said rotating means includes a disk member and a disk member activating means;
said disk member rotatively mounted on said base;
said activating means operatively associated with said disk member and capable of rotating said disk member in both said clockwise and said counterclockwise directions;
said disk member including a cam means mounted on said disk member such that said cam means rotates in response to rotation of said disk member;
said cam means capable of engaging with said movable end of said elongated member to move said movable end in said first and said second directions.

6. The sound producing device of claim 5 wherein:
said cam means includes at least one cam surface of a first type and at least one cam surface of a second type;
said cam surface of said first type engaging said movable end of said elongated member and moving said elongated member in said first direction and said cam surface of said second type engaging said movable end of said elongated member and moving said elongated member in said second direction.

7. The sound producing device of claim 6 wherein:
said elongated member comprises an elongated flexible member capable of being distorted about its longitudinal axis, said one end of said member being fixedly attached to said base and said movable end of said member moving in response to flexing of said member.

8. The sound producing device of claim 7 wherein:
said noise emitting means includes said disk member and a bell member;
said movable end of said flexible member striking said bell member in response to movement of said movable end of said flexible member in said first direction and said movable end of said flexible member striking said disk in response to movement of said movable end of said flexible member in said second direction.

9. The sound producing device of claim 8 wherein:
said cam surface of said first type engages said movable end of said flexible member and moves said movable end of said flexible member in a first pathway and said cam surface of said second type engages said movable end of said flexible member and moves said movable end of said flexible member in a second pathway, said first pathway being non-coplanar with said second pathway.

10. The sound producing device of claim 9 wherein:
at least a portion of said bell member is located in said first pathway such that said portion of said bell member is capable of being struck by said flexible member;
at least a portion of said disk member is located in said second pathway such that said portion of said bell member is capable of being struck by said flexible member.

11. The sound producing device of claim 10 wherein:
said cam means includes a plurality of said cam surfaces of said first type and a plurality of said cam surfaces of a second type.

* * * * *